US005881394A

United States Patent [19]

Garofalo

[11] Patent Number: 5,881,394

[45] Date of Patent: Mar. 16, 1999

[54] DIVING MASK WITH QUICK-RELEASE STRAP

[75] Inventor: Giovanni Garofalo, Rapallo, Italy

[73] Assignee: HTM Sport S.p.A., Italy

[21] Appl. No.: 613,639

[22] Filed: Mar. 11, 1996

[30] Foreign Application Priority Data

Mar. 15, 1995 [IT] Italy ..... GE95A0025

[51] Int. Cl.[6] ..... A61F 9/02

[52] U.S. Cl. ..... 2/428; 2/452

[58] Field of Search ..... 2/428, 430, 452, 2/429, 439; 351/43

[56] References Cited

U.S. PATENT DOCUMENTS 4,607,398 8/1986 Faulconer .
5,046,200 9/1991 Feder .
5,706,526 1/1998 Huang ..... 2/428
5,734,995 4/1998 Chiang ..... 2/428

FOREIGN PATENT DOCUMENTS 1539543 8/1968 France .

*Primary Examiner*—Peter Nerbun
*Attorney, Agent, or Firm*—Larson & Taylor

[57] ABSTRACT

Diving mask comprising a body and a strap attached to the sides of the said body, the said strap comprising: two box-like elements which are open at one end and each of which is attached at the other end to one side of the body of the said mask, a rotating pin being housed inside the said elements with its axis parallel to the longitudinal axis of the said opening; and a ribbon-like element made of elastomeric material, the two ends of which pass around the said rotating pins, the said ends being attached, such that their length can be adjusted, to two corresponding parts of a quick-release buckle.

3 Claims, 2 Drawing Sheets

DIVING MASK WITH QUICK-RELEASE STRAP

BACKGROUND OF THE INVENTION

FIELD OF THE INVENTION

The present invention relates to a mask used for diving, and in particular to a mask with a strap fitted with quick-release fastening means.

DESCRIPTION OF THE PRIOR ART

Generally, diving masks are provided with a strap, generally made of elastomeric material, which is designed to go round the diver's head and is secured to the sides of the body of the mask. In order to adjust the tightness of the strap, and therefore the fit of the body against the diver's face, the said body has two buckles, one on each side, by which it is attached to the strap and via which the length of the strap can be adjusted. The buckles can either be made in one piece with the said body or attached to it in various ways.

However, this arrangement has certain disadvantages. In particular, adjusting the tightness of the strap which is attached to the mask in this way is a rather awkward operation—one which is difficult for the diver to carry out while wearing the mask—and besides, each buckle needs to be adjusted in an identical manner in order to avoid unbalancing the mask. In addition, once the tightness has been adjusted, it is awkward for the diver to remove the mask from his face and allow it to hang from his neck, an operation which is commonly carried out before or after a dive, and even more awkward for him to put it back on.

SUMMARY OF THE INVENTION

The object of the invention is to provide a diving mask which is easy to put on and which enables simple adjustment of the tightness of the strap and therefore of the force with which the body fits against the diver's face.

The subject of the present invention is therefore a diving mask comprising a body and a strap attached to the sides of the said body, characterized in that the said strap comprises: two box-like elements which are closed at one end, being attached via this end to one side of the body of the said mask, and open at the other end, a rotating pin being supported inside the said elements and positioned transversely with respect to the said open end; and a ribbon-like element made of elastomeric material which passes around both the said rotating pins of the said box-like elements, the two extremities of the said ribbon-like element each being attached, such that its length can be adjusted, to one part of a quick-release buckle.

BRIEF DESCRIPTION OF THE DRAWINGS

Further advantages and features will become evident from the following description of an embodiment of the present invention which is given by way of nonlimiting example with reference to the appended drawings, in which.

DESCRIPTION OF THE PREFERRED EMBODIMENT OF THE INVENTION

Figure 1:
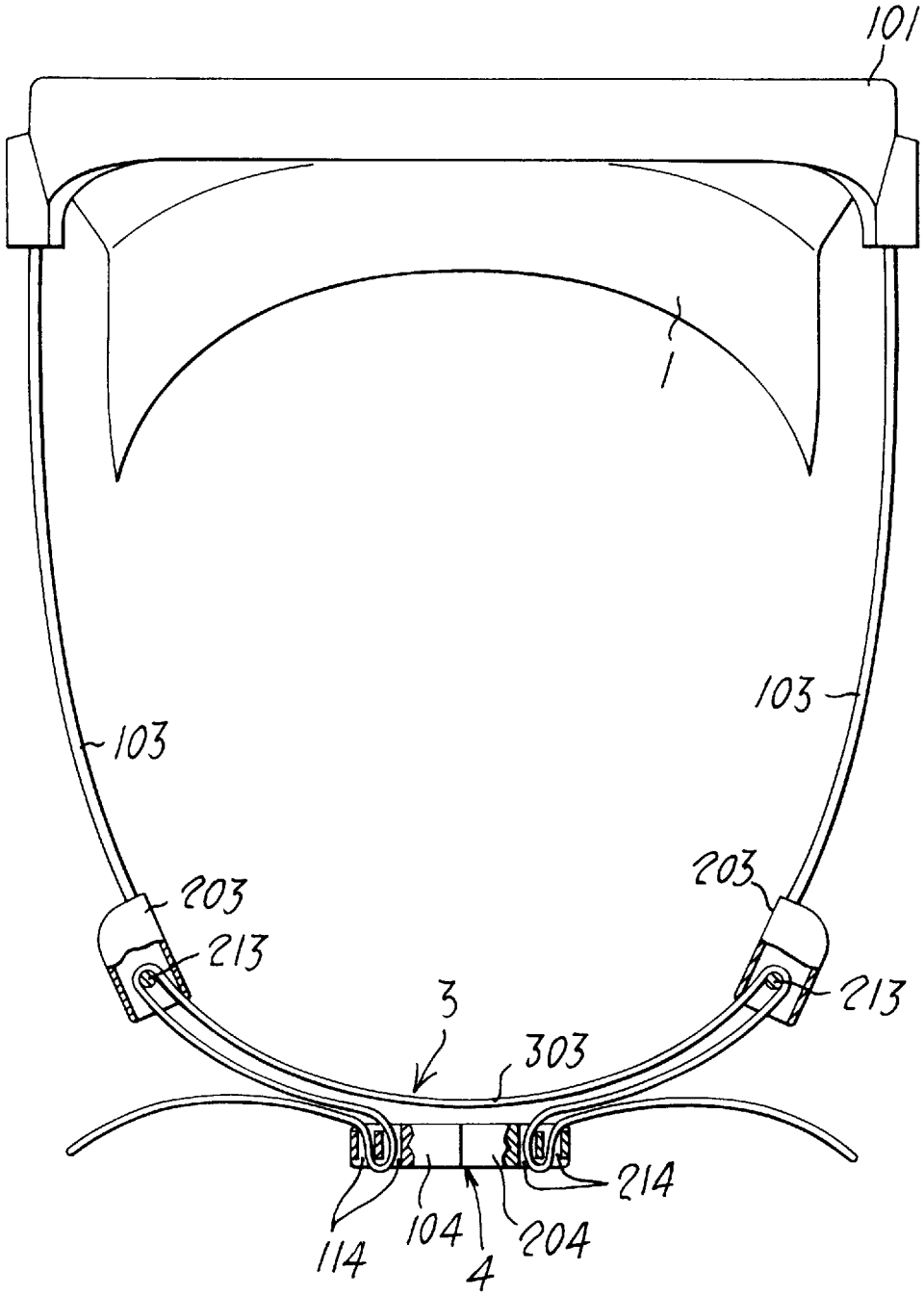
FIG. 1 is a plan view of a mask according to the present invention with some parts in cross-section.

In FIG. 1, the reference numeral 1 denotes the body of the mask according to the invention. This body 1 is provided at the front with a rigid frame 101. Attached to the sides of the said frame 101 is one end of the elements 103 which anchor the strap 3 of the mask. At the opposite end to that attached to the frame 101 of the body 1, each element 103 bears a box-like element 203 which is open at one end and houses a rotating pin 213. A ribbon-like element 303 made of elastomeric material, constituting the strap 3 proper, passes through the openings in the box-like elements 203 and around the rotating pins 213. The ends of the ribbon 303 are in turn attached, such that their length can be adjusted, to the two elements of a quick-release buckle 4, of a type which is known per se. For this purpose, one extremity of the ribbon 303 is inserted so as to loop through the two slots 114 of the part 104 of the buckle 4, and the other extremity of the ribbon 303 is inserted in the same way through slots 214 of the part 204.

Figure 2:
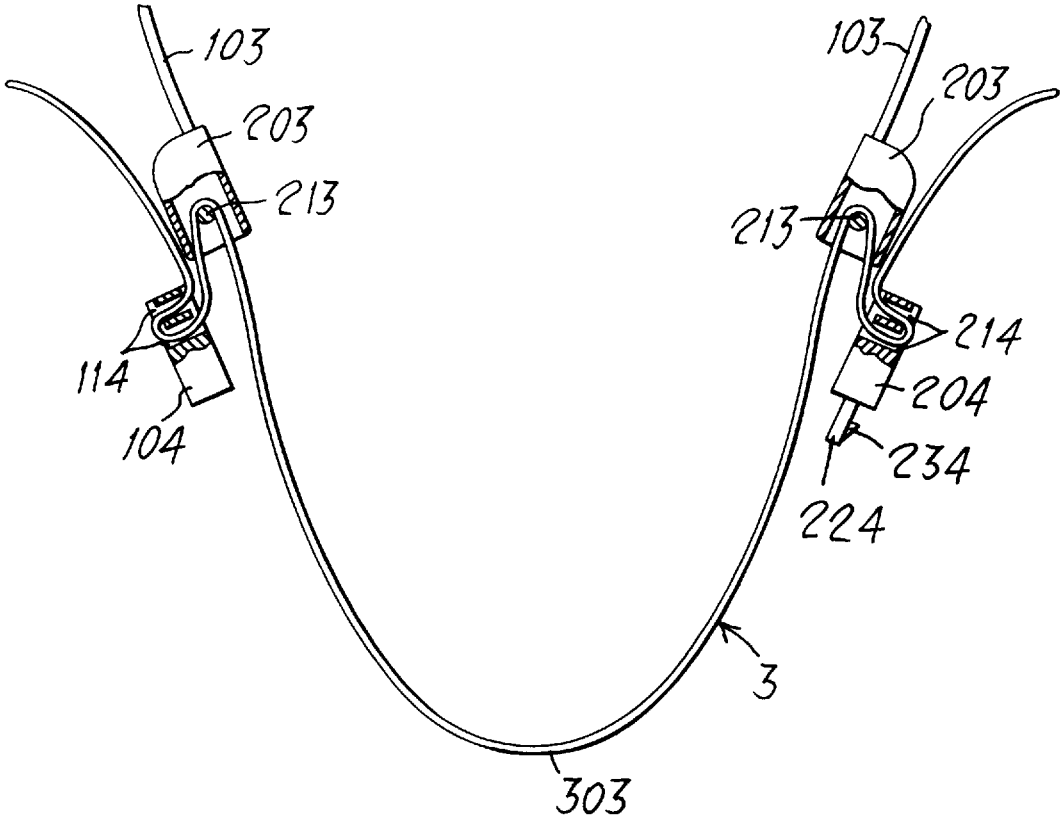
FIG. 2 is a plan view of the strap of the mask shown in FIG. 1, with the quick-release buckle in the open position.

FIG. 2 illustrates the strap 3 when the buckle 4 is in the open position. In this position the part 104 which is the female part of the buckle 4, and the part 204 which is the male part with the pin 224 provided with the tooth 234, are separated from each other.

The way in which the mask according to the invention works will be evident from the following description. The diver puts the mask on by positioning the body 1 against his face and then bringing the strap 3 to just above the nape of his neck. At this point it will be possible to adjust the tightness of the strap 3 and therefore the force with which the body 1 fits against the diver's face. By simply pulling on one of the two ends of the ribbon-like element 303, the strap 3 can be tightened to the desired degree. By virtue of the shape of the slots 114 and 214 in the two parts 104 and 204 of the buckle 4, which have well-defined edges, the element is locked as a result of friction in the position set by means of the tightening operation described above. Thereafter, by means of another simple movement, for example by pressing on the buckle with his finger, the diver can release it. The two parts 104, 204 of the said buckle 4 will separate and, as illustrated in FIG. 2, this enables the diver either to remove the mask easily without forcing the element 303 which is made of elastomeric material, or to allow it to hang from his neck, as is common practice among divers at the beginning or end of a dive. In addition, in this way the tightness of the strap, which was adjusted in the manner described above, is not altered in the slightest.

The mask thus designed is more comfortable for the diver to wear and enables the strap tightness to be adjusted easily. In addition, the quick-release buckle allows the diver to remove the mask or allow it to hang from his neck in an extremely simple and practical way.

I claim:

1. Diving mask comprising:

a body, a pair of anchors attached to sides of said body, each said anchor comprising a support element which is open at one end and which is attached at the other end to one side of the body of said mask, and a rotating pin housed inside said support element;

a ribbon-like element made of elastomeric material, the two ends of which pass around a respective said pin; and a two-part quick-release buckle having respective said ends of said strap attached to respective buckle parts thereof.

2. Diving mask according to claim 1, in which the said support elements are box-like elements.

3. Diving mask according to claim 1, in which said buckle includes respective closure parts on respective said ends thereof, and in which each said buckle part of said quick-release buckle has two transverse slots at an opposite end to that containing the closure part.

* * * * *